US006385924B1

(12) United States Patent
Emek

(10) Patent No.: US 6,385,924 B1
(45) Date of Patent: May 14, 2002

(54) REINFORCED WINDOW SYSTEM

(75) Inventor: Mordechay Emek, Kfar (IL)

(73) Assignee: Arpal Aluminum, Ltd., Lod (IL)

( * ) Notice: Subject to any disclaimer, the term of this patent is extended or adjusted under 35 U.S.C. 154(b) by 0 days.

(21) Appl. No.: 09/577,826

(22) Filed: May 25, 2000

(51) Int. Cl.[7] ..... E06B 3/00

(52) U.S. Cl. ..... 52/204.5; 16/328; 16/371; 16/374; 16/387; 16/389; 292/283; 292/DIG. 17

(58) Field of Search ..... 52/204.5; 16/371, 16/374, 328, 387, 389, 319, 352, 353; 292/DIG. 17, 283

(56) References Cited

U.S. PATENT DOCUMENTS

| | | | | |
|---|---|---|---|---|
| 170,702 | A | * | 12/1875 | Beckert, Jr. |
| 198,822 | A | * | 1/1878 | Stone |
| 856,856 | A | * | 6/1907 | Farmer |
| 1,679,513 | A | * | 8/1928 | Brown |
| 2,182,546 | A | * | 12/1939 | Raymond |
| 2,200,692 | A | * | 5/1940 | Fairley |
| 2,598,610 | A | | 5/1952 | Satz et al. |
| 2,694,842 | A | | 11/1954 | Scott et al. |
| 4,420,905 | A | * | 12/1983 | Kucharczyk |
| 5,232,260 | A | * | 8/1993 | Lippard |
| 5,943,111 | A | * | 8/1999 | Hernandez |

FOREIGN PATENT DOCUMENTS

| | | | |
|---|---|---|---|
| EP | 189813 | * | 1/1986 |
| GB | 520677 | | 5/1940 |
| GB | 533041 | | 2/1941 |
| GB | 7403 | * | 4/1990 |

* cited by examiner

*Primary Examiner*—Blair M. Johnson
(74) *Attorney, Agent, or Firm*—Oliff & Berridge PLC

(57) ABSTRACT

A reinforced locking mechanism for a casement window comprising at least one first eye hinge attached to any of a hanging stile, a shutting stile, a top rail and a bottom rail of the window sash, and at least one corresponding second eye hinge attached to a shutting jamb, a hanging jamb, an upper frame head and a lower frame sill of the window frame, respectively. Corresponding first and second eye hinges have coaxial eye portions and defining between them a longitudinal axis. A locking rod is displaceable along the longitudinal axis between a locked state in which it engages both the first and second eye hinges, and an unlocked state in which it is disengaged from at least one of the first and second eye hinges.

3 Claims, 3 Drawing Sheets

REINFORCED WINDOW SYSTEM

FIELD OF THE INVENTION

The present invention is in the field of reinforced window frames and in particular it is concerned with a reinforced locking mechanism suitable for use with casement windows.

Hereinafter in the specification and claims, the terms "window" and "windows" are interchangeably used with "door" and "doors", respectively.

BACKGROUND OF THE INVENTION

Casement windows with which the present invention is concerned, typically comprise a angular framework consisting of a frame anchored within an opening in a wall and a sash swingably mounted thereon with locking means preventing unintended opening thereof. Casement windows are either or both swingable inwards or outwards and at times, are also tiltable.

Windows which are designed to resist blasts caused, for example, by an explosion or any severe force applied thereto, are designed such that the window frame and window sash in place although, deformation thereof is allowed up to a certain extent. In such windows, the window pane itself is blast resistant to and is typically, although not explicitly, made of several layers of glass with reinforcing material embedded therebetween such as, for example, flexible polymeric material, resins, etc. which reinforce the window pane and prevent it from breaking into smithereens.

It is an object of the present invention to provide a reinforcing system for transferring mechanical energy from the window sash to the window fame, the latter typically being anchored to the wall.

SUMMARY OF THE INVENTION

According to the present invention where it is required to transfer mechanical energy from the window sash to the window frame, there is provided a reinforced locking mechanism for a casement window comprising a window sash supporting a window pane and mounted on a window frame fixed within an opening in a wall; the reinforced locking mechanism comprising at least one first eye hinge attached to any of a hanging stile, a shutting stile, a top rail and a bottom rail of the window sash, and at least one corresponding second eye hinge attached to a shutting jamb, a hanging jamb, an upper frame head and a lower frame sill of the window frame, respectively; where corresponding first and second eye hinges have coaxial eye portions and defining between them a longitudinal axis; and a locking rod displaceable along said longitudinal axis between a locked state in which it engages both said first and second eye hinges, and an unlocked state in which it is disengaged from at least one of said first and second eye hinges; said locking rod being linked to and displaceable by a linear displacement mechanism.

Preferably, the first and second eye hinges are slidingly received within corresponding flanges extending from the respective window sash or window frame member.

In order to reinforce the locking mechanism, there may be provided more than one first and second eye hinges which intervene with one another.

Typically, the locking rod is fixed to an elongate carrier member articulatedly displaceable to a corresponding member of the window sash. In accordance with a desired arrangement, the locking rod is adjustably fixed to the carrier member for adjusting its displacement with respect to the first and second eye hinges.

In accordance with the second aspect of the present invention there is also provided a casement window comprising a window sash supporting a window pane and mounted on a window frame fixed within an opening in a wall; and a reinforced locking mechanism comprising at least one first eye hinge attached to any of a hanging stile, a shutting stile, a top rail and a bottom rail of the window sash, and at least one corresponding second eye hinge attached to a shutting jamb, a hanging jamb, an upper frame head and a lower frame sill of the window frame, respectively; where corresponding first and second eye hinges have coaxial eye portions and defining between them a longitudinal axis; and a locking rod displaceable along said longitudinal axis between a locked state in which it engages both said first and second eye hinges, and an unlocked state in which it is disengaged from at least one of said first and second eye hinges; said locking rod being linked to and displaceable by a linear displacement mechanism.

BRIEF DESCRIPTION OF THE DRAWINGS

In order to better understand the invention and to see how it may be carried out in practice, some preferred embodiments will now be described, by way of non-limiting examples only, with reference to the accompanying drawings, in which:

FIG. 3 illustrate a reinforced locking mechanism for a casement window, wherein:

DETAILED DESCRIPTION OF A PREFERRED EMBODIMENT

Figure 1:
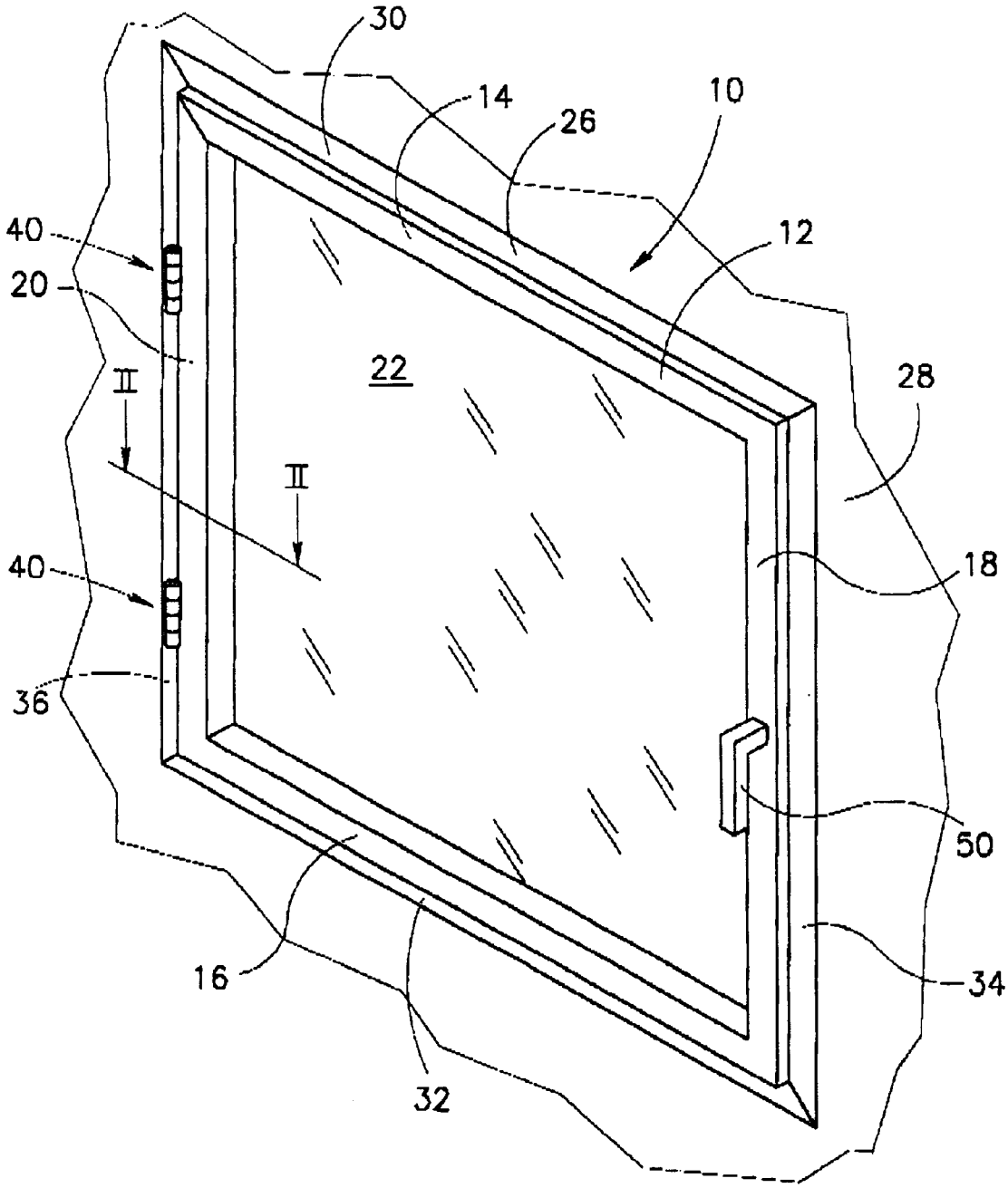
FIG. 1 is a perspective, general view of a casement window in accordance with the invention.

In order to prevent a window sash from deforming under influence of pressure, e.g. owing to violence or blast of an explosion, there is herein disclosed a reinforced locking mechanism for a casement window generally designated 10 and comprising a window sash 12 consisting of profiled top rail 14, bottom rail 16, shutting stile 18 and a hanging stile 20, supporting between them a reinforced window pane 22 as known per se.

Typically, with a construction in accordance with the present invention, the window pane 22 is of a generally blown reinforced type suitable for withstanding vandalism (physical attack), explosion blast and kinetic energy of bullets, shrapnel, etc.

The framework 10 further comprises an outer frame 26 anchored within an opening in the wall 28 (with or without a wall frame) and consisting of an upper head 30, a lower frame sill 32, a side shutting jamb 34 and a side hanging jamb 36.

Figure 2:
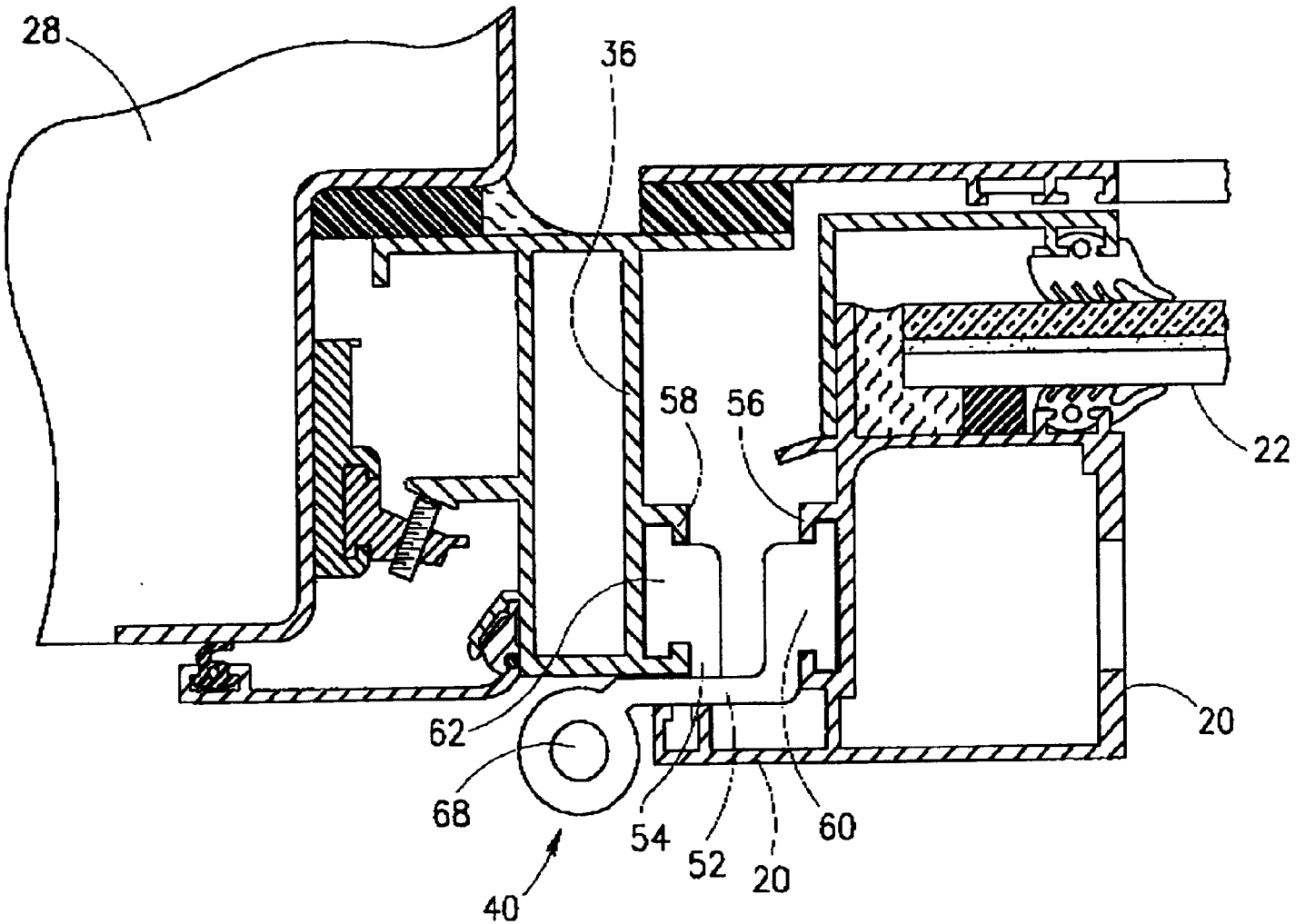
FIG. 2 is a section through lines II—II in FIG. 1.

The window sash 12 is pivotally mounted with respect to frame 26 by means of hinges 40 secured respectively to hanging jamb 20 and hanging stile 36 as known per se and as can be seen for example in sectional FIG. 2. Although not seen in the figures, it will be readily understood that framework 10 is provided with suitable locking means which, if so desired, may be a reinforced locking mechanism such as disclosed, for example, in Israel Patents Nos. 103168 and 112587, wherein rotary movement of a locking mechanism by means of handle 50 is converted into linear translational movement imparted to locking bars (not shown) slidingly secured along the shutting and hanging stiles, respectively.

With further reference also to FIG. 2, the hinge assembly generally designated 40 comprises a sash component 52 and a frame component 54, each being secured within a suitable flanged groove 56 and 58, respectively, formed in the hanging stile 20 and the hanging jamb 36, respectively, by means of corresponding engaging members 60 and 62, respectively.

Members 52 and 54 have coaxial hinge portions rotatable about a hinge pin 68.

Figure 3A:
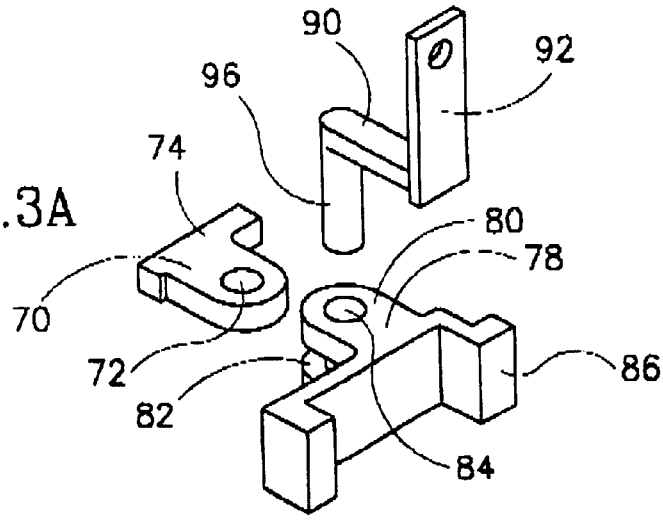
FIG. 3A is a perspective, exploded view of the reinforced locking mechanism.

With specific reference to FIG. 3A, there are illustrated the components of the reinforced locking mechanism comprising a first eye hinge member 70 formed with an eye portion 72 and a frame engaging portion 74 for sliding engagement within flanged portion 58 of hanging jamb 36 (see FIG. 2).

Extending opposite the first eye hinge 70 there is provided a second eye hinge 78 consisting of two flat hinged portions 80 and 82, each formed with an eye portion 84 and an engaging portion 86 for sliding engagement within corresponding flanged portion 56 of hanging stile 20 (see FIG. 2).

Figure 3B:
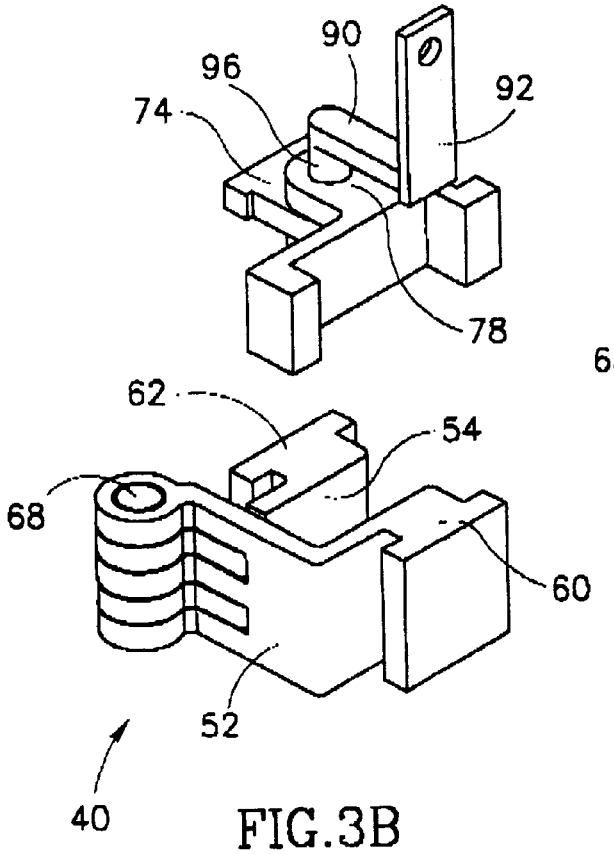
FIG. 3B is a perspective view illustrating the reinforced locking mechanism in a locked position extending above a hinge assembly of a casement window.
Figure 3C:
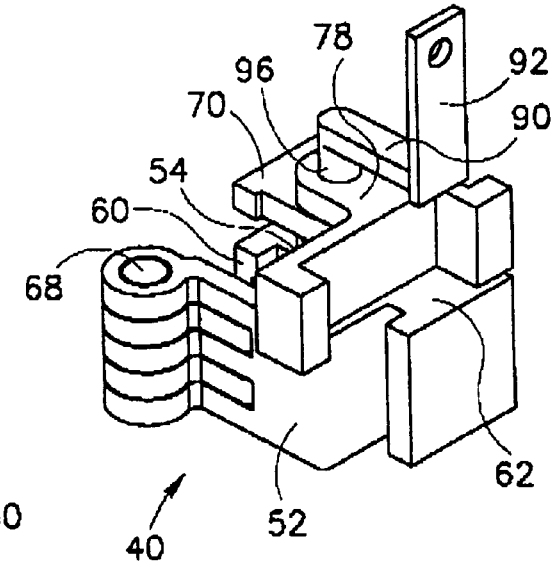
FIG. 3C is an exploded, superimposed view of the reinforced locking mechanism and the hinge assembly of a casement window.

The arrangement is such that in the closed position of the casement window, the first eye hinge 70 intervenes between the hinge members 80 and 82 of the second eye hinge 78, as seen in FIGS. 3B and 3C.

Attached to the sliding locking bar (not shown) there is a locking member 90 formed with a flat portion 92 for engagement with the sliding bar of a locking mechanism (not shown), and a pinlike portion 96 adapted for engagement with coaxial eyes 72 and 84 of eye hinges 70 and 78, respectively, in their locked position, as seen in FIGS. 3B and 3C. This arrangement improves the support of the window sash within the window frame, in the locked, secured position and transfers energy generated during blast to the window frame.

While a preferred embodiment has been shown and described, it is to be understood that it is not intended thereby to limit the disclosure, but rather it is intended to cover all modifications and arrangements falling within the spirit and the scope of the invention as defined in the appended claims.

For example, the reinforced locking assembly may be an add-on kit.

I claim:

1. A reinforced locking mechanism for a casement window provided with a window sash supporting a resistant window pane adapted to withstand physical force, blast and the kinetic energy of bullets and shrapnel, and mounted on a frame fixed within an opening in a wall;

said sash being defined by the following four sash elements: a hanging stile, a shutting stile, a top rail and a bottom rail;

said frame being defined by the following corresponding four frame elements: a shutting jamb, a hanging jamb, an upper head and a lower sill; at least one hinge connecting said hanging stile to said hanging jamb said locking mechanism which provides a reinforcing system in which mechanical energy is transferred from the window sash to the window frame comprising:

a first eye hinge attached to said hanging stile separately from said hinge;

a second eye hinge attached to said hanging jamb separately from said hinge, said hanging stile and said hanging jamb having coaxial eye portions which together define a longitudinal axis;

a locking rod linearly displaceable along said longitudinal axis between a locked state in which said locking rod engages both said first and second eye hinges, and an unlocked state in which said locking rod is disengaged from at least one of said first and second eye hinges; and said rod in the locked state transferring mechanical energy from the first eye hinge attached to one of the sash elements to the second eye hinge attached to the corresponding frame element to dissipate this energy and thereby enhance the blast resistance of the window.

2. A reinforced locking mechanism according to claim 1, wherein the first and second eye hinges are slidingly received within corresponding flanges extending from the respective hanging stile or hanging jamb member.

3. A reinforced mechanism according to claim 2, wherein the first and second eye hinges intervene.

* * * * *